US010710228B2

(12) United States Patent
West et al.

(10) Patent No.: US 10,710,228 B2
(45) Date of Patent: Jul. 14, 2020

(54) STRIKING TOOL WITH ATTACHED STRIKING SURFACE

(71) Applicant: Estwing Manufacturing Company, Inc., Rockford, IL (US)

(72) Inventors: Joshua D. West, Rockford, IL (US); Steven M. Flosi, Machesney Park, IL (US); John W. Ryan, Jr., Belvidere, IL (US)

(73) Assignee: Estwing Manufacturing Company, Inc., Rockford, IL (US)

( * ) Notice: Subject to any disclaimer, the term of this patent is extended or adjusted under 35 U.S.C. 154(b) by 0 days.

(21) Appl. No.: 15/704,896

(22) Filed: Sep. 14, 2017

(65) Prior Publication Data

US 2018/0001458 A1 Jan. 4, 2018

Related U.S. Application Data

(63) Continuation of application No. 14/587,452, filed on Dec. 31, 2014, now Pat. No. 9,789,597.

(60) Provisional application No. 61/949,838, filed on Mar. 7, 2014.

(51) Int. Cl.

| | |
|---|---|
| ***B25D 1/02*** | (2006.01) |
| ***B25D 1/12*** | (2006.01) |
| ***B25D 7/00*** | (2006.01) |

(52) U.S. Cl.

CPC ..... *B25D 1/02* (2013.01); *B25D 1/12* (2013.01); *B25D 7/00* (2013.01); *B25D 2250/051* (2013.01)

(58) Field of Classification Search

CPC ..... B25D 1/02; B25D 1/12; B25D 2250/105; B25D 2250/051; B25D 2250/361; B25D 2222/54; B25D 2222/57; B25D 7/00

See application file for complete search history.

(56) References Cited

U.S. PATENT DOCUMENTS

| | | | | | |
|---|---|---|---|---|---|
| 1,424,161 | A | * | 8/1922 | Foley | B25D 1/02 254/104 |
| 3,000,414 | A | * | 9/1961 | Cordis | B25D 1/02 81/22 |
| 3,130,762 | A | * | 4/1964 | Kerr | B25D 1/02 473/329 |
| 3,942,567 | A | * | 3/1976 | Richilano | B22D 19/00 81/26 |
| 5,375,486 | A | * | 12/1994 | Carmien | B25G 3/12 81/21 |
| 6,128,977 | A | * | 10/2000 | Gierer | B25D 1/12 7/144 |

(Continued)

*Primary Examiner* — Robert J Scruggs
(74) *Attorney, Agent, or Firm* — Quarles & Brady LLP

(57) ABSTRACT

An example hammer disclosed herein includes a handle. The hammer also includes a head comprising a neck. The neck has a tapered receiving surface and an end face. The hammer further includes a cap comprising a tapered mounting surface. The mounting surface is surrounding and engaging the receiving surface to permanently affix the cap to the neck. A first circumference of engagement at a first end of a length of engagement between the mounting surface and the receiving surface is greater than a second circumference of engagement at a second end of the length of engagement. The first end is farther from the end face of the neck than the second end.

20 Claims, 11 Drawing Sheets

(56) References Cited

U.S. PATENT DOCUMENTS

| | | | | |
|---|---|---|---|---|
| 6,463,832 | B1 * | 10/2002 | Cox | B25D 1/02 81/22 |
| 7,107,874 | B1 * | 9/2006 | Chen | B25D 1/02 30/308.3 |
| 9,044,846 | B1 * | 6/2015 | Dawson | B25D 1/00 |

* cited by examiner

STRIKING TOOL WITH ATTACHED STRIKING SURFACE

CROSS REFERENCE TO RELATED APPLICATIONS

This application is a continuation of U.S. application Ser. No. 14/587,452, which was filed on Dec. 31, 2014 and claims the benefit of and priority to U.S. Provisional Application No. 61/949,838, filed Mar. 7, 2014. Both U.S. application Ser. No. 14/587,452 and U.S. Provisional Application No. 61/949,838 are incorporated by reference in their entireties herein.

REFERENCE REGARDING FEDERALLY SPONSORED RESEARCH OR DEVELOPMENT

Not applicable

SEQUENCE LISTING

Not applicable

BACKGROUND OF THE INVENTION

1. Field of the Background

The present invention relates generally to hammers with heads having a striking surface attached thereto, and more specifically, where the head and the striking surface may be different materials.

2. Description of the Background

As depicted in FIGS. 1 and 1A, a basic striking tool 10, for example, a claw hammer, includes a grip 12 disposed on a bottom section of a handle 14 that further includes a handle neck 16. Opposite of the grip 12 is a head 18. The head 18 includes a neck 20 and a poll 22 with a striking surface 24 having a beveled edge or chamfer 26. Opposite of the poll 22, a claw portion 28 is disposed. The claw portion 28 may include a split 30 that enables a user to remove nails (not shown) from a board (not shown) and the like.

Various striking tools have attempted to improve on the hammer shown in FIGS. 1 and 1A by attaching at least one striking surface to the head. Such striking tools generally secure the striking surface to the head by forcing the striking surface onto the head, employing a removable locking mechanism such as a ring, a pin, bolt, or threads, by treating the striking surface and head with heat, or by welding.

In one example, a hatchet includes a head with a malleable body. A steel striking surface with a dowel is attached to the head by forcing the dowel into a hole in the head. The hole has a slightly smaller diameter than the dowel causing the striking surface to be firmly secured to the head without the use of a rivet or heat.

In another example, a hammer includes a head made of a soft metal, such as copper. To provide a hard face on the hammer, a shell of hard material, like steel, having a recess with a larger diameter at its bottom portion than its opening is secured to the head. The soft head has a cylindrical projection of uniform diameter that is equal to that of the opening of the shell. The projection of the head is inserted into the shell. By applying pressure to the shell, the soft metal of the head completely fills the hollow in the shell. Additional pressure secures the shell to the head more tightly.

In another example, a hammer has a head made of a hard material with a cylindrical socket with an undercut circumferential groove. A copper or other malleable material plug may be inserted into the socket to form a striking surface. The plug is secured in place by spreading into the undercut circumferential groove upon application of pressure. Continued use secures the plug more tightly. When the plug is worn out, it may be removed and replaced with a new plug.

A further example of a hammer with a striking surface attached to the head includes an impact tip with a tapered shank that is received within a tapered socket of the head. A shock absorbing washer surrounds the shank of the impact tip and is interposed between an annular surface of the impact tip that faces an annular surface of the head. The impact tip is permanently secured to the head.

Another example includes a hammer with a head made of a light weight metal, such as a titanium or titanium alloy, with a hard striking surface or working tip attached thereto by a threaded connector, welding, brazing, adhesives, or shrink fitting (heat treatment).

However, such prior striking tools often relied on heavy construction that added to the weight of the striking tool or used malleable metal heads or striking surfaces, which led to short-lived tools. Further, prior locking mechanisms, whether for permanent affixation of striking surfaces or that allowed striking surfaces to be replaced were not designed for long life. In addition, other connecting methods added significant expense either in terms of the costs for materials and equipment required for affixation and/or in the added steps or energy required to carry out such methods. There is a need, therefore, for light weight striking tools with durable striking surfaces attached economically and permanently that provide greater ease of use, prolonged tool life, and reduced manufacturing cost.

SUMMARY OF THE INVENTION

An example hammer disclosed herein includes a handle. The hammer also includes a head comprising a neck. The neck has a tapered receiving surface and an end face. The hammer further includes a cap comprising a tapered mounting surface. The mounting surface is surrounding and engaging the receiving surface to permanently affix the cap to the neck. A first circumference of engagement at a first end of a length of engagement between the mounting surface and the receiving surface is greater than a second circumference of engagement at a second end of the length of engagement. The first end is farther from the end face of the neck than the second end.

Another example hammer disclosed herein includes a cap having a striking surface, a cavity, and a tapered mounting surface within the cavity. The cap is a first material. The example hammer also includes a head including a neck. The head is a second material different than the first material. The neck has a central axis and a tapered receiving surface. A portion of the neck is received in the cavity to permanently affix the tapered receiving surface to the tapered mounting surface via a friction fit. The tapered receiving surface converges toward the central axis as the neck extends toward the striking surface.

An example striking tool disclosed herein includes a cap including a tapered mounting surface and a striking surface. The example striking took also includes a head having a neck. The neck has a tapered receiving surface and an end face. A portion of the neck is received in the cap to permanently affix the mounting surface to the receiving surface via a friction fit. A first circumference of engagement at a first end of a length of engagement between the mounting surface and the receiving surface is greater than a second circumference of engagement at a second end of the length of engagement. The first end is farther from the end face of the neck than the second end.

BRIEF DESCRIPTION OF THE DRAWINGS

Other aspects and advantages of the present invention will become apparent upon reading the following detailed description and upon reference to the drawings in which.

DETAILED DESCRIPTION OF THE INVENTION

Figure 1:
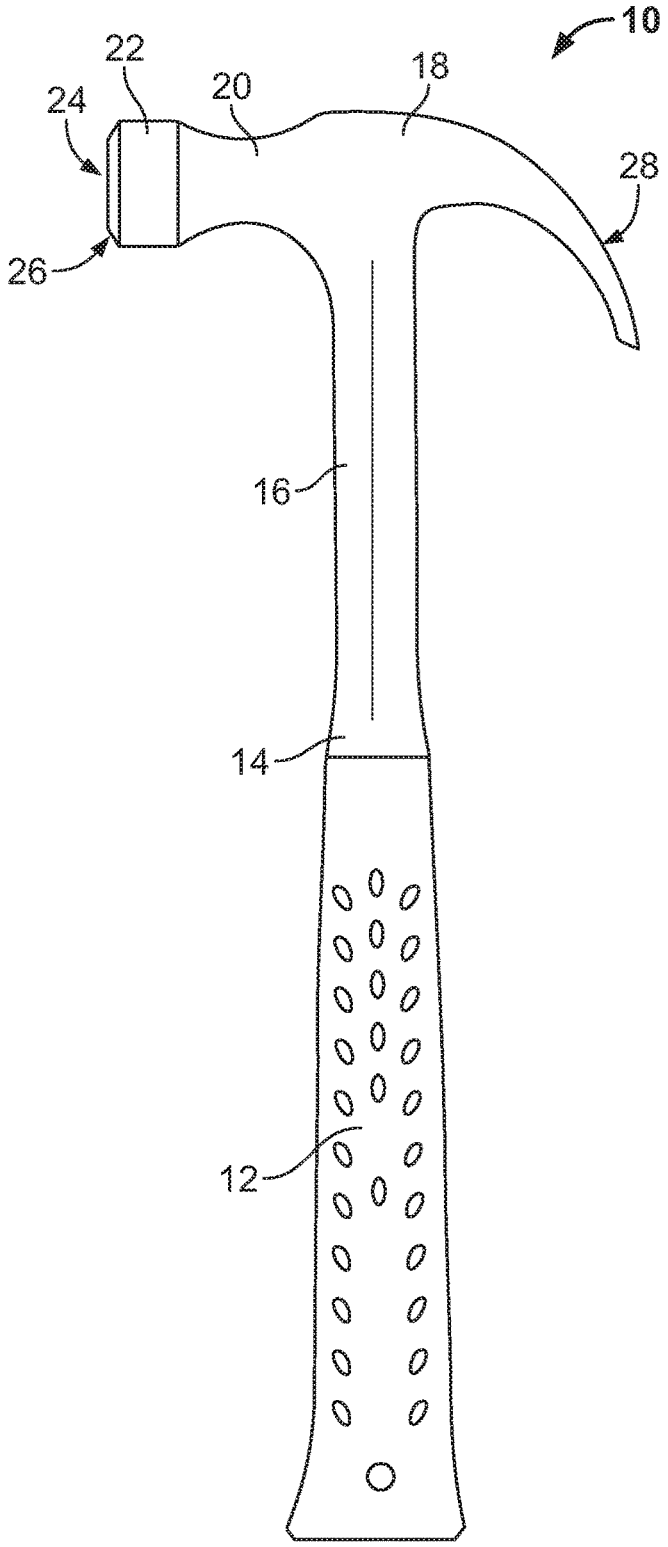
FIG. 1 (PRIOR ART)
FIG. 1 is a side elevational view of a first embodiment of a striking tool according to one embodiment.
Figure 1A:
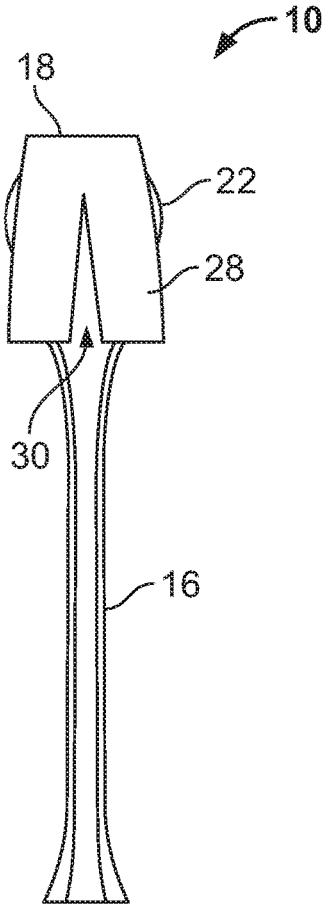
FIG. 1A (PRIOR ART)
FIG. 1A is a rear elevational view of a top portion of the striking tool of FIG. 1.

To overcome the deficiencies of the prior art, the present disclosure is directed to a striking tool 10 that adds to the concepts of FIGS. 1 and 1A and may be formed by attaching one or more striking surfaces to the head 18, which may be formed separately or from a single piece of material with the handle, by means including a pin, a threaded connection, shrink fitting, welding, brazing, adhesives, and the like. Herein, like structures are referred to with the same reference numbers. Furthermore, contemplated striking tools 10 may only include a subset of the features of striking tool 10 from FIGS. 1 and 1A and/or may include additional features.

Figure 2:
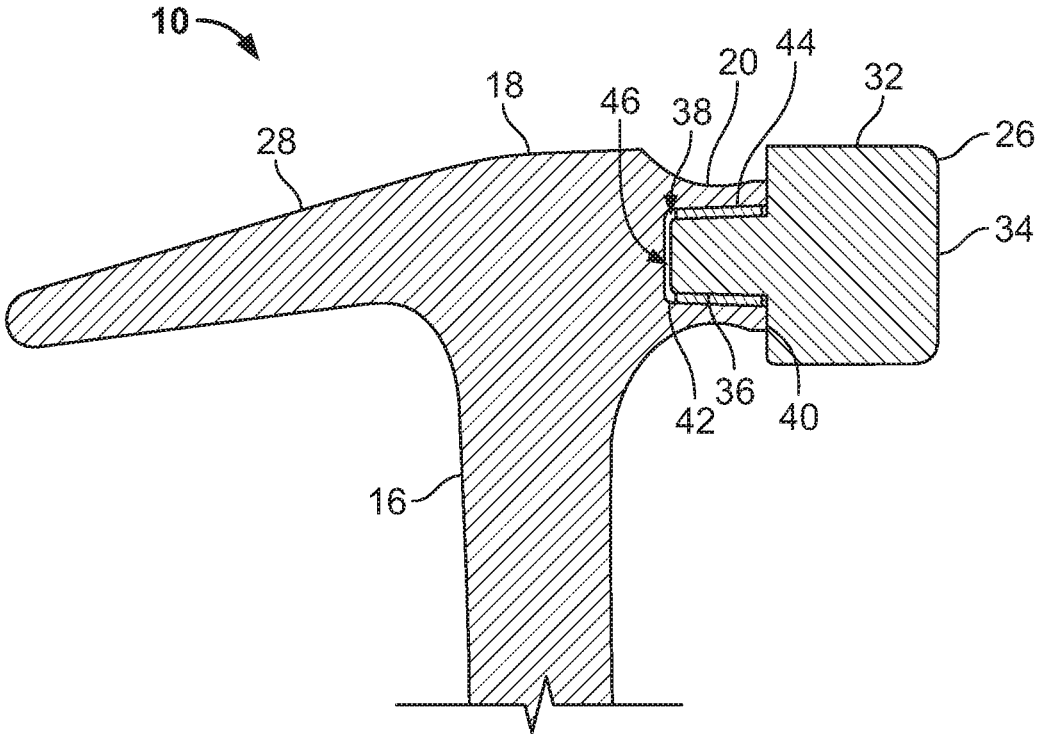
FIG. 2 is a cross-sectional side view of a top portion of a striking tool according to another embodiment.

For example, in the embodiment of FIG. 2, a striking cap (cap) 32 is affixed to the head 18 of the striking tool 10. The cap 32 includes a striking surface 34 adapted for striking another surface (not shown), such as a fastener like a nail, spike, stake, staple, pin, or rivet. The striking surface 34 may also be appropriately shaped for working metal, concrete, stone, wood, etc. Opposite of the striking surface 34 is a mounting surface 36 that extends from the cap 32 and is received within a cavity 38 that extends into a face 40 of the head 18. The cavity 38 is defined by a receiving surface 42 adapted to receive the mounting surface 36 of the cap 32. Interposed between the mounting surface 36 and the receiving surface 42 is a bushing 44 that substantially surrounds the mounting surface. The bushing 44 is adapted to form a friction fit between the mounting surface 36 and the receiving surface 42 to affix the cap 32 within the cavity 38 of the head 18. The bushing 44 may be used to attach the cap 32 in combination with other means herein disclosed. For example, the bushing 44 may be used in combination with a tapered receiving surface 42 and/or a tapered mounting surface 36.

In this embodiment, force generated by impact of the striking surface 34 is transferred through the cap 32 and distributed over the mounting surface 36 through the bushing 44 to the receiving surface 42. As a result, the mounting surface 36 and the receiving surface 42 may become more tightly associated through use of the striking tool 10, and the bushing 44 may deform to some degree causing an increase in its overall surface area. The increase in surface area of the bushing 44 is believed to increase the amount of friction between the mounting surface 36 and the receiving surface 42 over time and provide an ever stronger bond between the cap 32 and the head 18.

Figure 3:
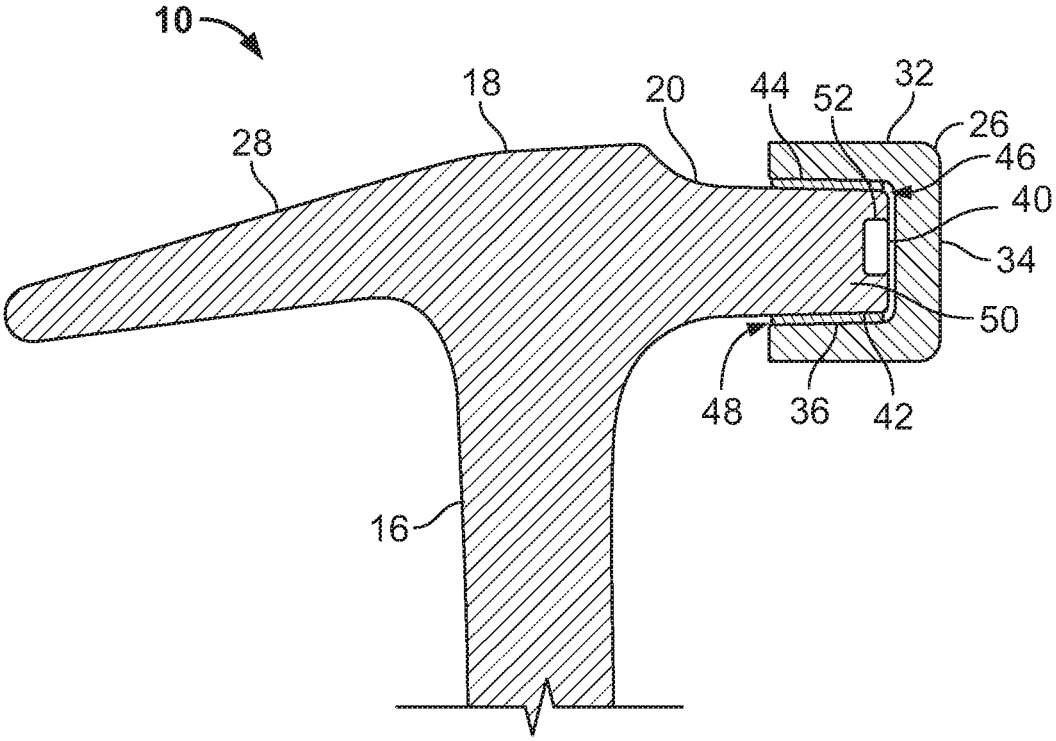
FIG. 3 is a cross-sectional side view of a top portion of a striking tool according to a further embodiment.

While not wishing to be bound by theory, it is believed that the attachment of the cap 32 as depicted in FIG. 3 (a generally concave mounting surface 36 within the cap) may be preferable to having the cavity 38 in the neck 20 of the striking tool 10, as seen in FIG. 2. In the application of a striking tool 10 used for driving a nail and the like, the striking surface 34, to be durable, must be made of a harder stronger material which will have both a higher tensile and compressive strength when compared to the material used to manufacture the head 18 of the striking tool 10. Additionally, the bearing strength of the material used to make the cap 32 will be higher than that of the material used to make the head 18. In metals, the compressive strength will typically be equal to or greater than the tensile strength. Additionally, bearing strength will be higher than either tensile or compressive strength.

If a tapered mounting surface 36 or bushing 44 surrounding the mounting surface is pressed into a cavity 38 in the neck 20, the vast majority of axial force used is directed outward generally perpendicularly to the receiving surface 42 or bearing surface of the cavity in the neck, and to a greater degree when the receiving surface is angle/tapered. The product of this force multiplied by the static coefficient of friction between the two materials of the cap 32 and head 18 and the area of engagement is the axial force required to remove the mounting surface 36 from the cavity 38 as well as the radial force required to rotate the mounting surface in the cavity.

The cap 32 will be under a bearing load since it will be under compression from all sides of the tapered cylinder (cavity 38) simultaneously. The material surrounding the cavity 38 in the neck 20 will be under a tensile load. As the tensile load exceeds the tensile strength of the material surrounding the cavity 38, the material deforms outwardly and thins around the mounting surface 36. This, in turn, leads to a reduced cross-section of the material around the cavity 38 further reducing the tensile strength of the material. If no additional force is applied, the frictional forces holding the mounting surface 36 against the receiving surface are diminished allowing for the undesirable separation of the cap 32 from the head 18. However, if additional force is applied, it is transmitted to the material having the weakened cross-sectional area around the cavity 38. As the material progressively thins, it cracks, ultimately leading to a relatively rapid failure of the striking tool 10 that can take place over the course of only a few blows of the striking tool.

Therefore, since the tensile strength will fail prior to the bearing strength of the material, it is preferred to use the stronger material having the higher tensile strength as the material that is under tensile load. Since it is desirable that the cap 32 be made of the harder, stronger material, it is then also preferred to have a cavity in the cap subjecting a softer material (e.g., aluminum alloy and the like) in the head 18 and neck 20 to the bearing load. When constructed in this manner, the frictional force holding the cap 32 onto the head 18 may increase with use overtime without the risk of failure of the striking tool 10.

When the cap 32 is affixed to the head 18 in this way with an appropriately sized bushing 44 or without a bushing, a void space 46 may be formed between an inner surface of the cap and the head that provides shock absorption when the striking tool 10 is used to strike an object. The void space 46 may be filled with any manner of shock absorbing materials including gas, foam, fabric, rubber, plastic, wood, malleable metal, and combinations thereof. In one embodiment, the void space 46 is permanent, such that throughout the useful lifetime of the striking tool 10, the void space never bottoms out.

Figure 3A:
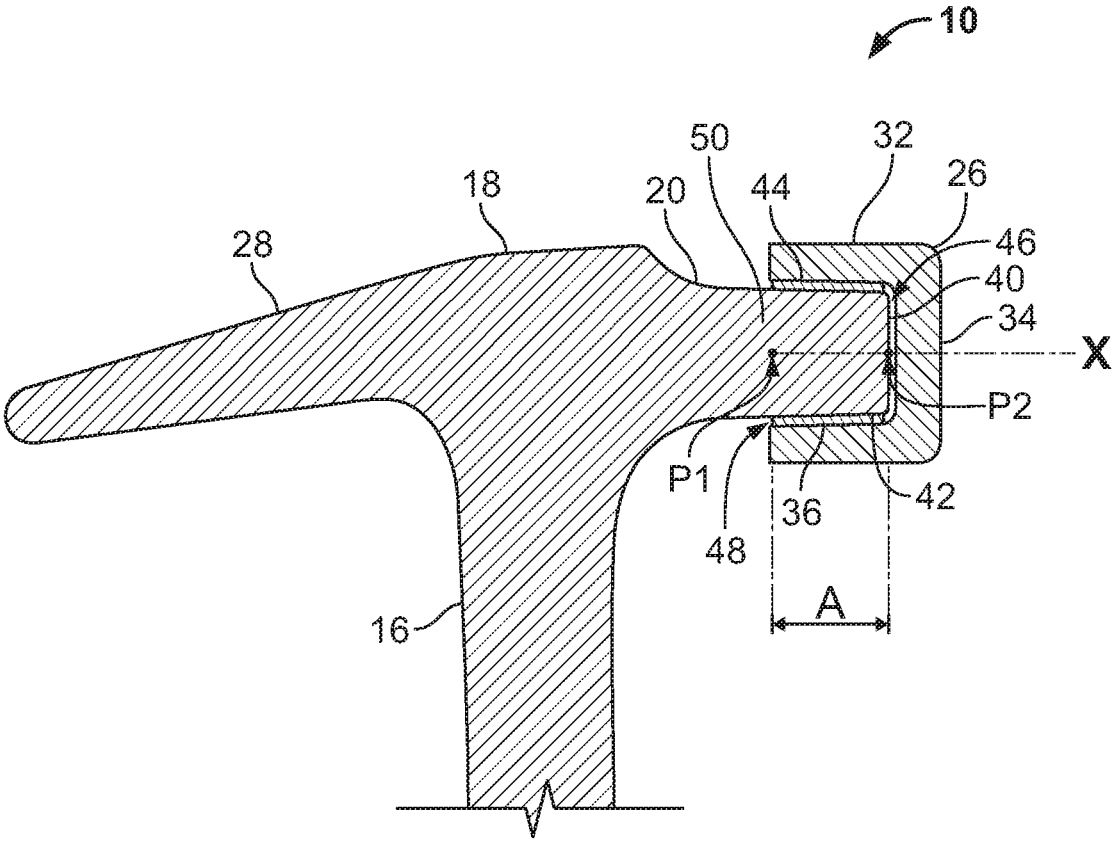
FIG. 3A is a cross-sectional side view of a top portion of a striking tool similar to the embodiment of FIG. 3.

The mounting surface 36 and the receiving surface 42 may each have a cylindrical shape or may be tapered. In FIG. 2, the mounting surface 36 of the cap 32 has a slight taper as it extends from the cap (a "closing taper"), and the receiving surface 42 has a complementary taper (e.g., a similar or the same taper) as the cavity 38 extends into the face 40. In another embodiment, either the mounting surface 36 or the receiving surface 42 is cylindrical and the other is tapered in either direction. Any shape or taper that allows for affixation of the cap 32 to the head 18 is contemplated herein. For example, either or both of the mounting surface 36 and the receiving surface 42 may have a taper measured along one side thereof with an effective angle of about 10°, or about 7°, or about 5°, or about 3°, or about 1°, or less than about 10°, or less than about 7°, when measured relative to a central axis (such as is seen in FIG. 3A). When the effective angle of the receiving surface 42 is measured relative to a plane formed by the face 40, the receiving surface may have an effective angle measured along one side thereof that ranges from about 80° to about 100°, or from about 83° to about 97°, or about 85° to about 95°, or about 87° to about 93°, about 89° to about 91°. Similar effective angles are contemplated for the mounting surface 36 and may similarly be determined relative to a plane formed by the striking surface 34.

In one embodiment shown in FIG. 3A, a tapered mounting surface 36 engaged directly or indirectly with a tapered receiving surface 42 will have a length of engagement (A) by which a cap 32 may be secured to a head 18 by a friction fit alone or in combination with a mechanical and/or chemical bond. The length of engagement (A) may have a central axis (X), for example, that is generally concentric with a center of the receiving surface and a center of the striking face 34 when attached to the striking tool 10. A first perimeter or circumference of engagement may be measured around the receiving surface 42 at a first point (P1) along the central axis (X) at a first end of the length of engagement (A). A second perimeter or circumference of engagement may be measured around the receiving surface 42 at a second point (P2) along the central axis (X) at a second end of the length of engagement (A). The largest perimeter or circumference of engagement may be either proximal or distal to the striking surface 34 of the cap 32. A ratio of the length of engagement (A) to the absolute value of the difference between the first perimeter measured at the first point (P1) and second perimeter measured at the second point (P2) may be greater than about 0.4, or about 0.8, or about 1.2, or about 1.5, or about 2.0, or about 2.9. P1 may be spaced from P2 a distance of about 0.1 cm, or about 0.5 cm, or about 1 cm, or about 2 cm, or about 3 cm, and P2 may be located on the face 40, or may be spaced from the face along the central axis X a distance of about 0.1 cm, or about 0.2 cm, or about 0.4 cm, or about 1 cm.

In an alternative embodiment, the first perimeter or circumference of engagement and the second perimeter or circumference of engagement may be equal.

Similarly, the bushing 44 may be configured to have a taper that may be complementary to that of either or both of the mounting surface 36 or the receiving surface 42 or may have a different configuration that still enables affixation of the cap 32 to the head 18. Further, the bushing 44 may be made of any material that allows for permanent affixation of the cap 32 to the head 18. Alternatively, the bushing 44 may allow removable affixation of the cap 32 to the head 18. The bushing 44 may be made of one or more metals, adhesives, polymers, plastics, and combinations thereof and be formed by one or more pieces of material. In one embodiment, the bushing 44 is made of single metal or metal alloy that is softer than that of the head 18 and the cap 32. Without wishing to be bound by theory, it is believed that using a softer material may provide greater manufacturing tolerance, that is, allow for dimensional variations in manufacturing of the bushing 44, cap 32 (mounting surface 36), and/or head 18 (receiving surface 42). In one embodiment, the bushing may have a hardness that is softer than at least one of the head 18 and the cap 32 or both the head and cap. In another embodiment, the bushing 44 may have the same hardness as at least one of the head material and the cap material or both the head and cap materials. Without wishing to be bound by theory, it is also contemplated that the bushing 44 be manufactured from a hardened material having a hardness equal to or greater than that of the mounting surface 36 and the receiving surface 42 when the components are precision ground or similarly shaped after forging, casting, and/or machining to form a precision mating surface. Further, when the head 18 and the cap 32 have precision mating surfaces, the bushing 44 may be optional.

In the embodiment shown in FIG. 3, the cap 32 is concave and has a hollowed portion 48, analogous to cavity 38, in which the mounting surface 36 is disposed. The receiving surface 42 is disposed on an extension 50 of the neck 20, which is inserted into the hollowed portion 48 of the cap 32 to affix the cap to the head 18. In this embodiment, the bushing 44 substantially surrounds the receiving surface 42. Further, the void space 46 is formed opposite of the striking surface 34 within the cap 32. The face 40 of the neck 20 may be partially hollowed out and one or more magnets 52 may be placed therein to effectively magnetize the striking surface 34 of the cap 32. Alternatively, the cap 32 may include a magnet (not shown).

Figure 4A:
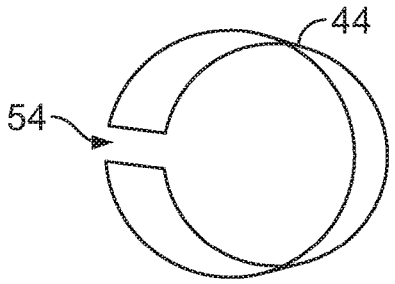
FIG. 4A is a top side elevational view of a bushing according to one embodiment.
Figure 4B:
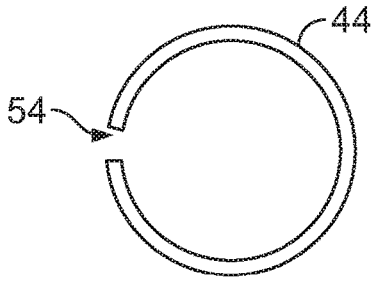
FIG. 4B is a plan view of the bushing of FIG. 4A.
Figure 4C:
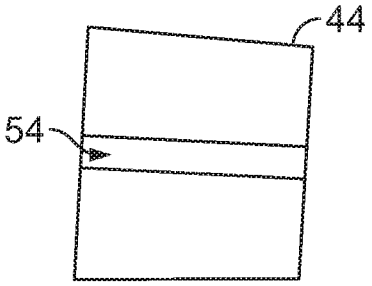
FIG. 4C is a side elevational view of the bushing of FIG. 4A.

In FIGS. 4A-C, differing views of the bushing 44 according to one embodiment are shown. In this embodiment, the bushing 44 is a solid piece with a uniform thickness, slight taper, and an open space 54 in the form of a slit extending along a length thereof. It is envisioned that the bushing 44 may have a taper independent of the mounting surface 36 or receiving surface 42 of any desired angle. The open space 54 enables the bushing 44 to deform during use of the striking tool 10 and increase its surface area and corresponding bond between the cap 32 and the head 18.

Figure 4D:
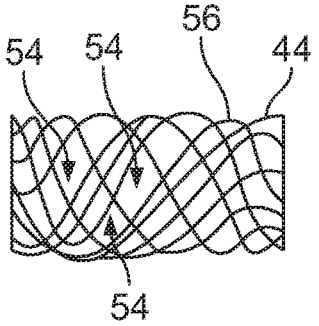
FIG. 4D is a side elevational view of a bushing according to another embodiment.
Figure 4E:
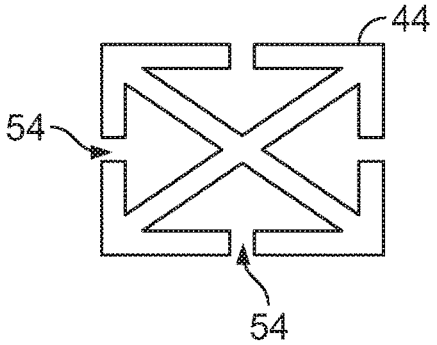
FIG. 4E is a side elevational view of a bushing according to a further embodiment.
Figure 4F:
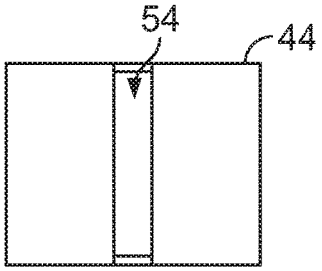
FIG. 4F is a top plan view of the bushing of FIG. 4E.

In FIGS. 4D-F, two additional embodiments of bushings are shown. In FIG. 4D, the bushing 44 has a mesh-like configuration with interwoven strands 56 of material between which are interspersed open spaces 54. FIGS. 4E and F illustrate a variation of the cylindrical bushing 44 shown in FIGS. 4A-C. Here, the bushing 44 has several open spaces 54 that allow for greater expansion of the bushing as force is applied thereto during use.

Figure 5A:
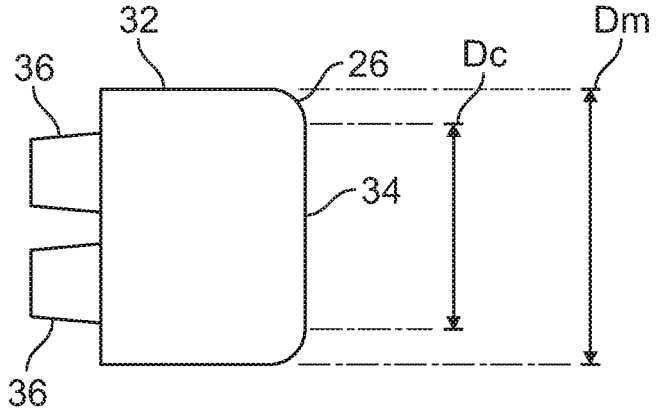
FIG. 5A is a side elevational view of a striking cap (cap) according to a further embodiment.
Figure 5B:
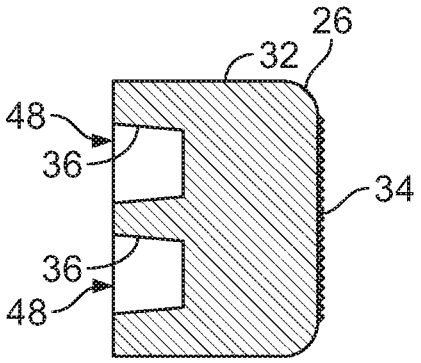
FIG. 5B is a cross-sectional side view of a cap according to one embodiment.
Figure 5C:
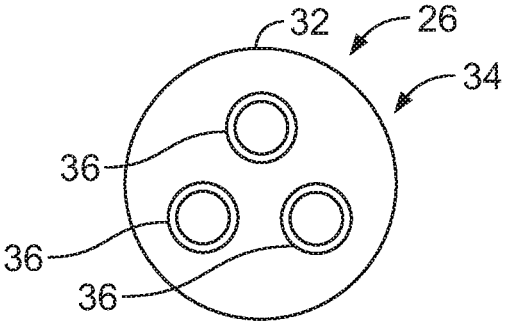
FIG. 5C is a bottom plan view of a cap according to one embodiment.
Figure 5D:
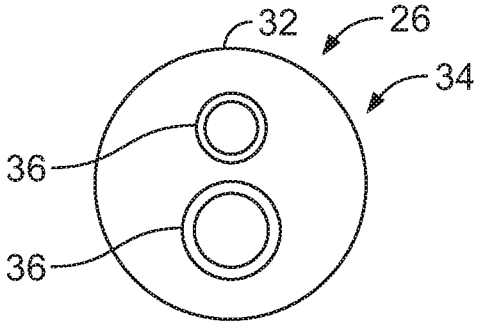
FIG. 5D is a bottom plan view of a cap according to another embodiment.

FIGS. 5A-5D depict certain contemplated variations of the mounting surfaces 36 of the cap 32. In FIG. 5A, two separate mounting surfaces 36 extend from the cap 32 opposite of the striking surface 34, which has a central diameter $D_c$ and a maximum diameter $D_m$. The maximum diameter may be any desirable length, such as about 1 inch, or about 2 inches, or about 3 inches, or about 4 inches. The central diameter $D_c$ (or striking face) equals the maximum diameter $D_m$ minus the width of the chamfer 26, which may be about 10% of the maximum diameter $D_m$. In this embodiment, complementary receiving surfaces (not shown) would be disposed in the head of the striking tool. A plurality of separate mounting surfaces 36 may create a stronger bond between the cap 32 and the head 18 by increasing the total surface area of contact between the mounting surface and corresponding receiving surface. As seen in FIG. 5B, a milled or serrated striking surface 34 is contemplated herein and may be included on caps 32 with one or more mounting surfaces 36. In FIG. 5B, the cap 32 includes a plurality of mounting surfaces 36 in a configuration analogous to that of FIG. 3. FIG. 5C illustrates a rear view of a cap 32 with 3 mounting surfaces 36. FIG. 5D illustrates a cap 32 with an orientation feature, in this case, in the form of mounting surfaces 36 of different size that serve to orient the cap on the head 18 in a single orientation. Similarly, in the case of a single, non-circular mounting surface (or multiple mounting surfaces), the orientation feature may be a receiving surface 42 in the shape of, for example, an oval, a triangle, a square, or any other shape (not shown) that achieves rotational alignment of the cap 32 on the head 18. It is similarly contemplated that the receiving surface 42 may include multiple shapes at the same time, for example, such as a proximal portion (at P1 along central axis (X) of FIG. 3A) with a circular (or other shaped) cross-section and a distal portion (at P2) with a different cross-sectional shape (for example, star-shaped, oval, triangular, rectilinear, etc. . . . ) (not shown). As well, an orientation feature, such as a slot, ridge, bump, thread, and the like (not shown) may be disposed on the mounting surface 36 and have a complementary opposite feature on the receiving surface 42 to form a lock and key mechanism for orientation of the cap 32 and ease of manufacture of the striking tool 10. Such a configuration facilitates assembly of the striking tool 10 where the striking tool may incorporate a slot on a top surface (not shown) that may be used for a nail starter (not shown) on the top of the striking tool. Likewise, the nail starter may also incorporate a magnet attached to the cap or aligned with the slot when attached to the head (or both) to hold a nail (not shown). While specific examples of one or more mounting surfaces 36 of a cap 32 are shown herein, mounting surfaces that extend from or into the caps (or combinations of both) are contemplated.

Figure 5E:
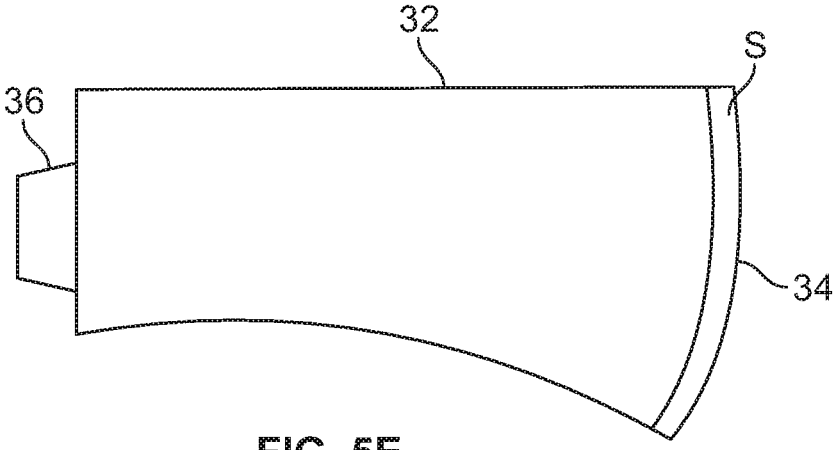
FIG. 5E is a side elevational view of a cap according to a further embodiment.
Figure 5F:
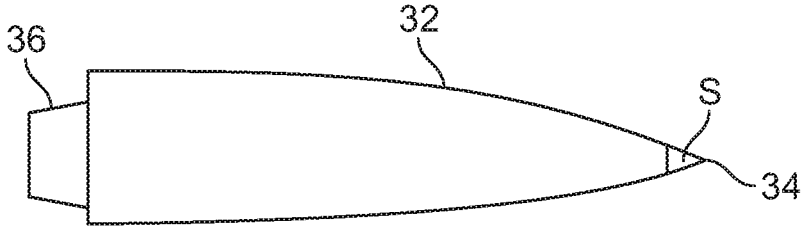
FIG. 5F is a top plan view of the cap of FIG. 5E.
Figure 5G:
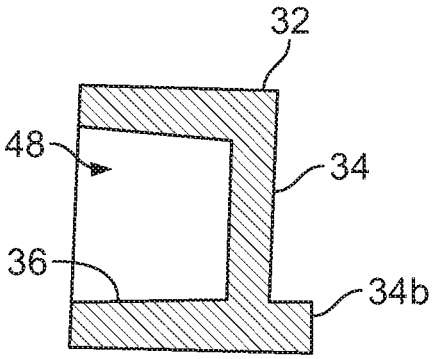
FIG. 5G is a cross-sectional side view of a cap according to another embodiment.
Figure 5H:
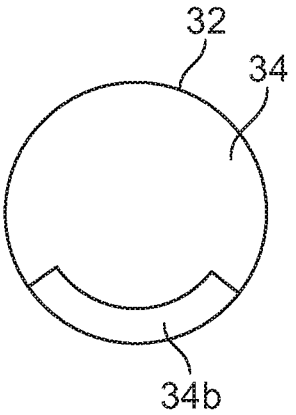
FIG. 5H is a front elevational view of a cap according to a further embodiment.

Caps 32 contemplated herein may include any type of striking surface that is associated with a striking tool 10, as known in the art, and may vary by size and shape, as desired. For example, in addition to the flat striking surfaces 34 shown in the figures, it is further contemplated that caps 32 may include a cutting edge (S), such as when the cap is a bit of an axe or a hatchet (FIG. 5E) or pick (FIG. 5F) with a pointed striking surface, and the like. In a further embodiment seen in FIGS. 5G and H, the cap 32 may include a striking surface 34 and one or more depth control striking surfaces 34*b* of any shape, such as may be used for a siding hammer, similar to that disclosed in U.S. Pat. No. 7,617,749.

Figure 6:
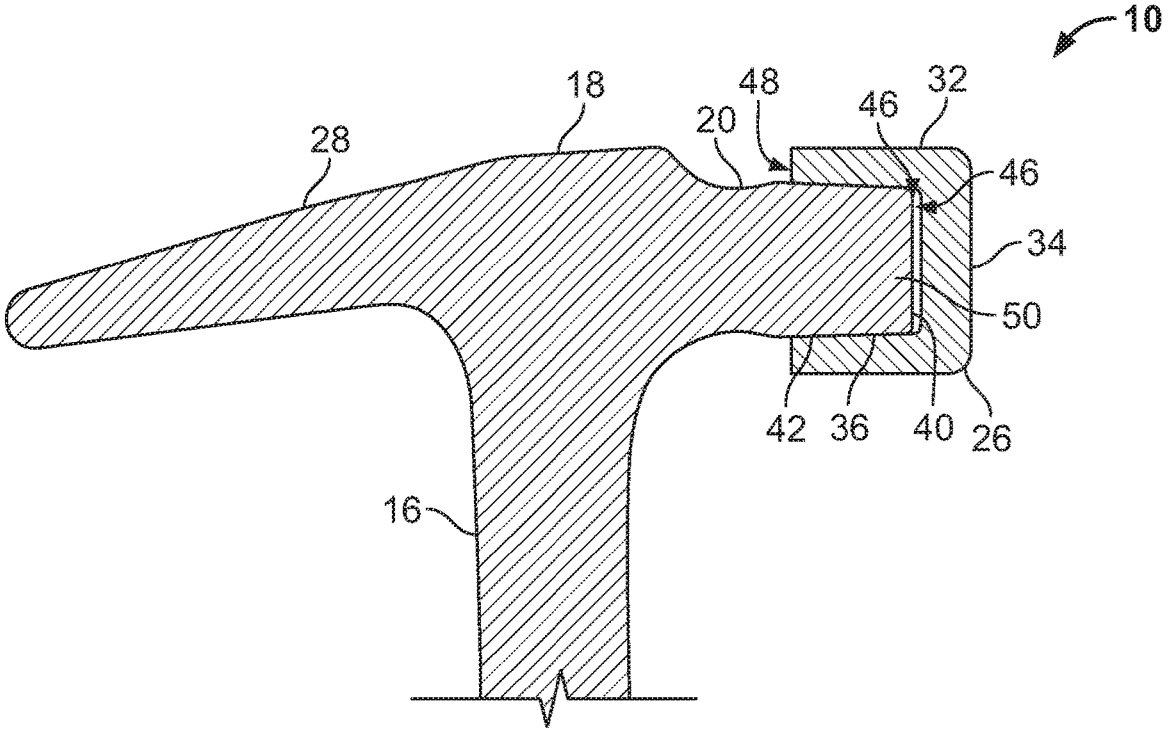
FIG. 6 is a cross-sectional side view of a top portion of a striking tool according to another embodiment.
Figure 7:
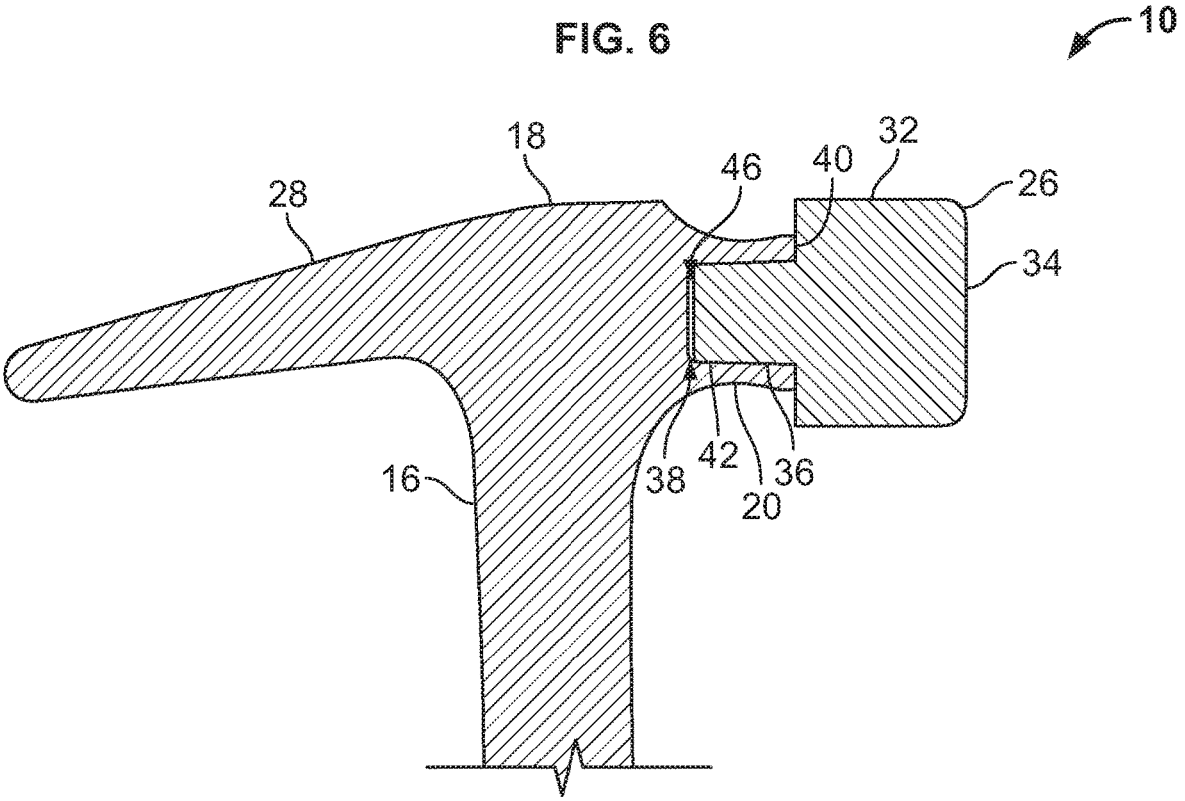
FIG. 7 is a cross-sectional side view of a top portion of a striking tool according to yet another embodiment.

In other embodiments shown in FIGS. 6 and 7, the cap 32 is attached directly to the neck 20, such that the mounting surface 36 and receiving surface 42 are in direct contact with one another. It is further envisioned that a material may be interposed between the cap 32 and the neck 20 to facilitate manufacture, longevity, reversibility, shock reduction, or balance of the striking tool 10. For example, materials interposed between the cap 32 and the neck 20 may include adhesives, polymers, composites, shock absorbing materials, weight adding materials, insulators, lubricants, and the like.

Figure 8A:
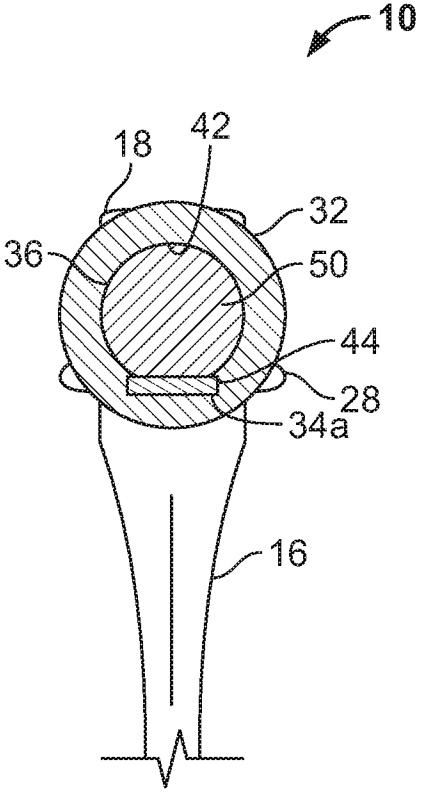
FIG. 8A is a cross-sectional view of the top portion of the striking tool of FIG. 8 along the lines 8A-8A.
Figure 8:
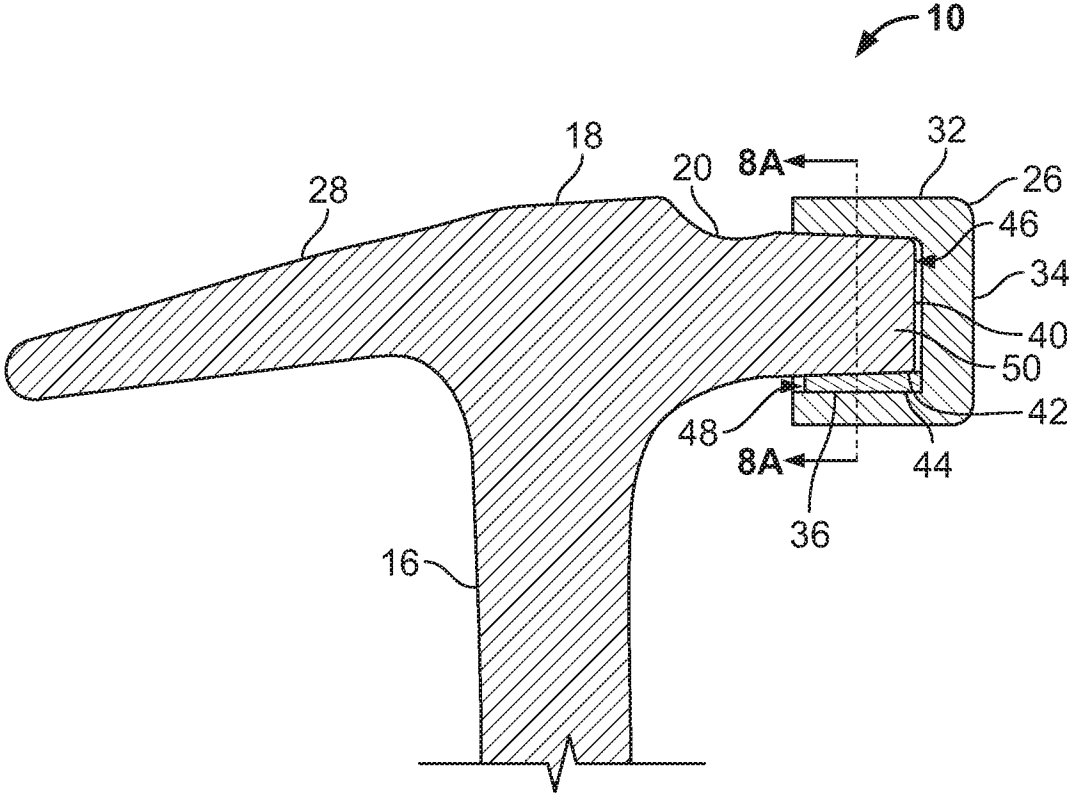
FIG. 8 is a cross-sectional side view of a top portion of a striking tool according to a further embodiment.

FIGS. 8 and 8A depict another embodiment contemplated herein where a wedge-shaped bushing 44 engages a flat portion of the receiving surface 42. Here, the bushing 44 serves as an orientation feature and is seated on a corresponding flat portion or pocket 34*a* in the cap 32, the result of which being that the cap is oriented when affixed on the head 18 with a single orientation that prohibits rotation of the cap during manufacture and thereafter.

Figure 9:
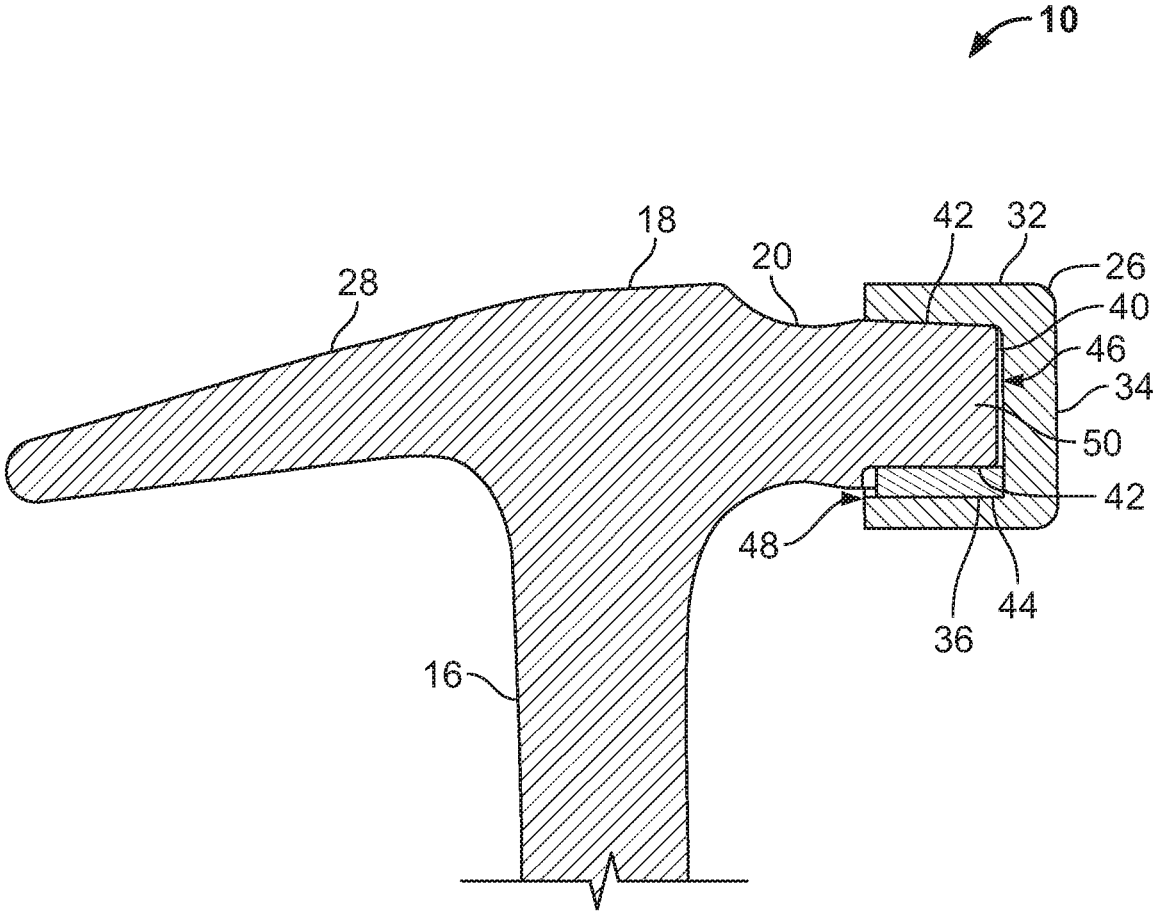
FIG. 9 is a cross-sectional side view of a top portion of a striking tool according to a further embodiment.

FIG. 9 depicts another embodiment similar to that shown in FIGS. 8 and 8*a*. Here, a portion of the receiving service 42 is recessed and the cap 32 may have a pocket (not shown) and/or a flat surface to orient the cap when affixed to the head 18. In this embodiment, any of the recessed receiving surface 42, pocket 34*a*, or flat mounting surface 36 may be angled to create a friction fit.

Figure 10:
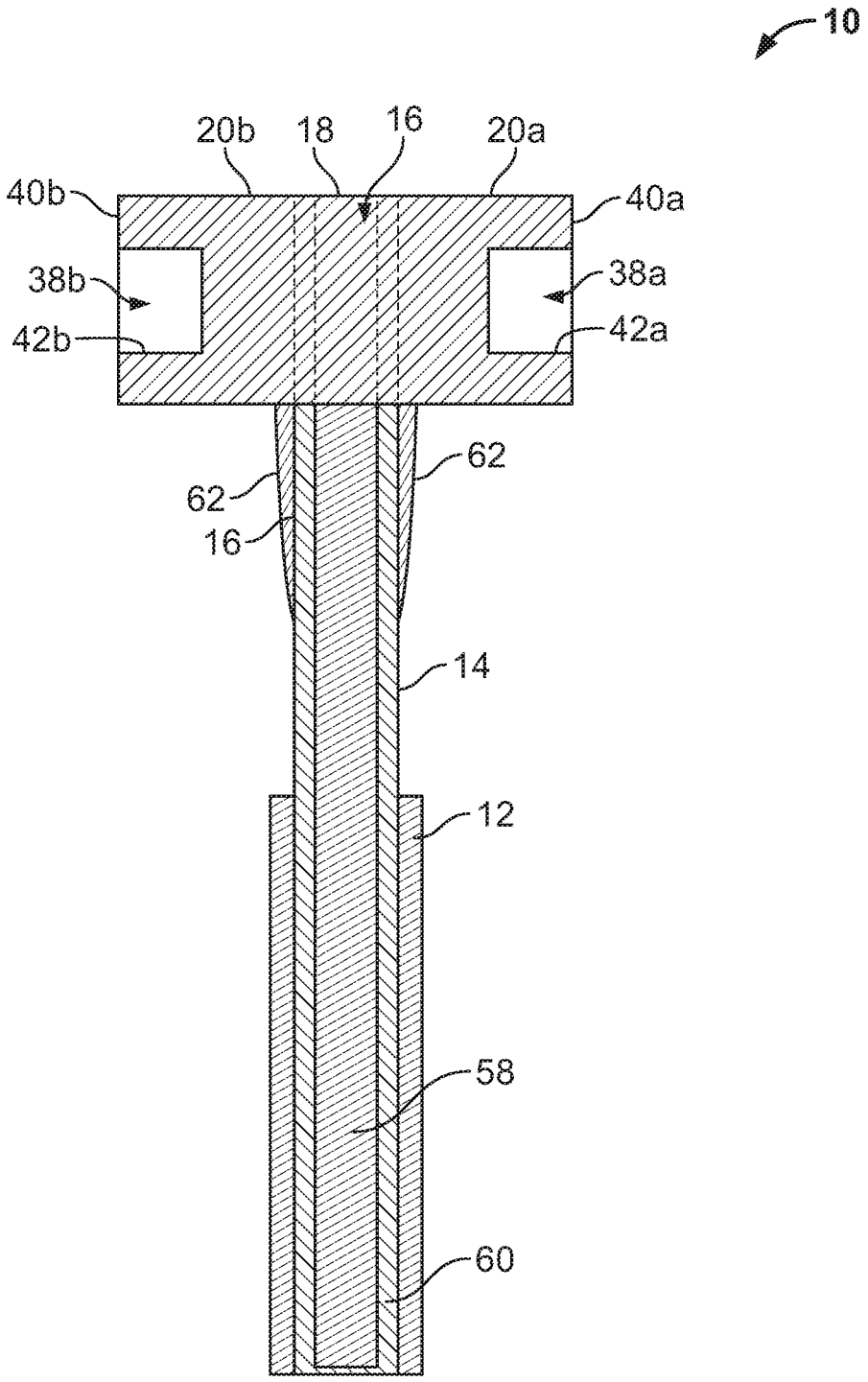
FIG. 10 is a cross-sectional side view of a striking tool according to another embodiment.
Figure 11:
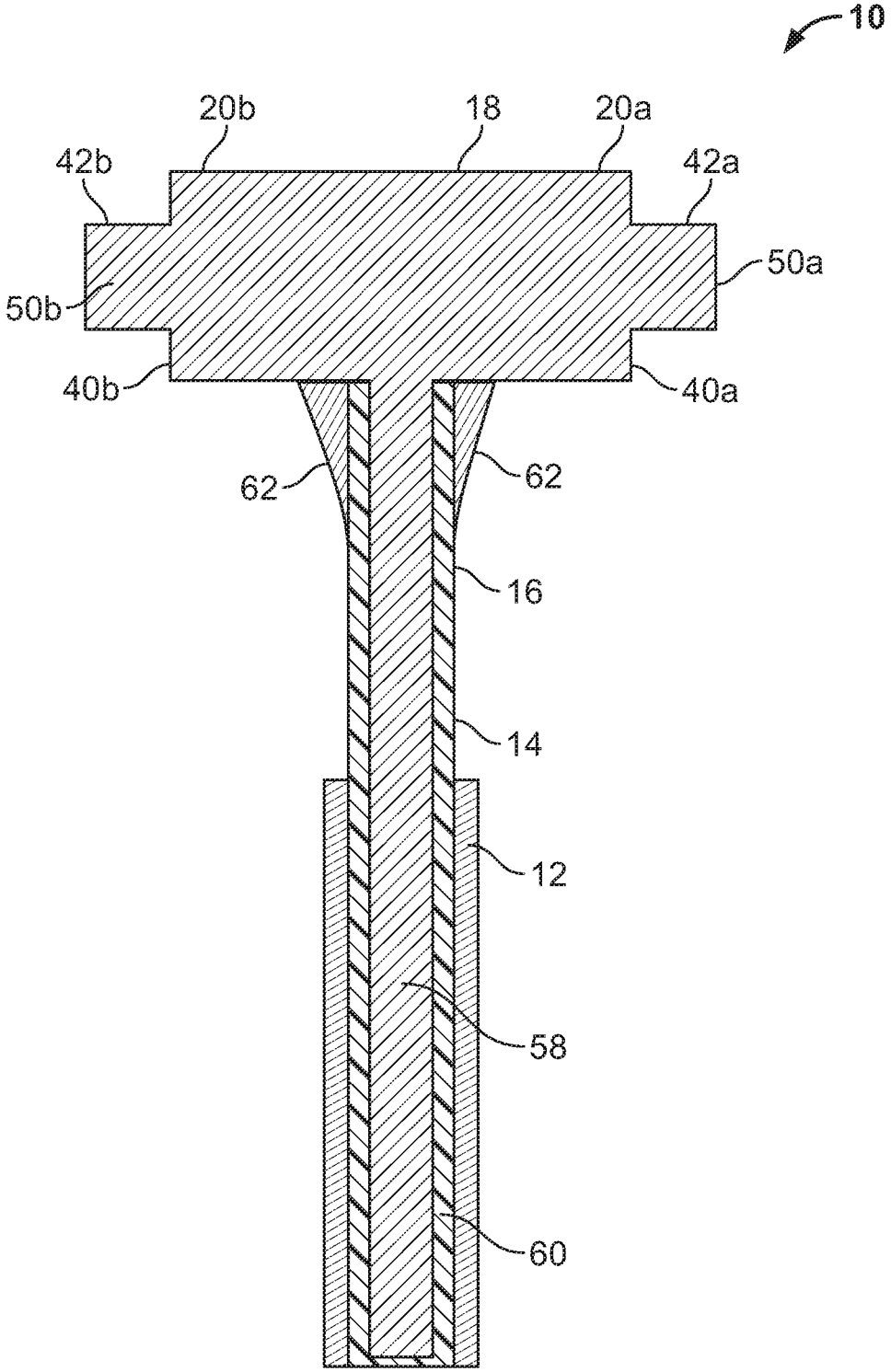
FIG. 11 is a cross-sectional side view of a striking tool according to a further embodiment.

FIG. 10 depicts an example of a striking tool 10 with a head 18 having two necks 20*a* and 20*b* and two cavities 38*a* and 38*b* on opposite faces 40*a* and 40*b* of the head, respectively. Each cavity 38*a* and 38*b* has a receiving surface 42*a* and 42*b*, respectively, for receiving two caps (not shown) that may be the same or different. In this way, any manner of striking tool 10 may be made that utilizes, for example, a light weight material for the head 18 and handle 14 and a hard, durable material for the striking surface 34. FIG. 11 depicts another example of a striking tool 10. Here, the receiving surfaces 42*a* and 42*b* extend from the faces 40*a* and 40*b* of the head 18. The striking tools depicted in FIGS. 10 and 11 may either be of a unitary, one-piece head 18 and handle 14 construction (formed from a single piece of material) or the head may be attached to the handle by means known in the art.

While the handle 14 and head 18 of the striking tools 10 in FIGS. 10 and 11 are depicted as being made from metal, any material may be used in striking tools of the present disclosure. Examples of materials that may be used for striking tools 10 contemplated herein include metals, without limitation, polymers, plastics, composites, wood, carbon fiber, graphite, fiberglass, foam, rubber, leather, and combinations thereof. Specific metals contemplated include, among others, titanium, aluminum, steel, and alloys thereof. Further materials contemplated for use herein include polymers and metal alloys and superalloys suitable for additive manufacturing. A material may be selected, for example, based on its hardness, malleability, strength, density, weight, among other factors.

In another embodiment, the handle 14 of the striking tools 10 of FIGS. 10 and 11 may include a core 58 made of one material and an overlay or overmold 60 of the same or a different material, or a laminate of layers of the same or multiple materials. In another embodiment, the grip 12 may be molded over the overlay material 60. For example, the core 58 may be titanium, aluminum, steel, or alloys thereof, and the overlay 60 may be plastic, a polymer, a composite, foam, carbon fiber, fiberglass, wood, graphite, or combinations thereof. Alternatively, the core 58 may be a lightweight, rigid polymer and/or foam with an overlay 60 of plastic, graphite, carbon fiber, fiberglass, metal, wood, or combinations thereof to protect the core. The overlay or overmold may provide greater strength to the underlying core to permit a lighter core without sacrificing strength. Such lighter construction of the striking tools 10 may reduce fatigue of a user during use as well as increase swing speed while maintaining the durability required for continued strenuous use. Moreover, with lighter weight construction, striking tools 10 may have an increased handle length to generate greater force when swung by a user with little to no increased effort needed as compared to, for example, an all steel striking tool of the same length.

In a further embodiment, the striking tools 10 of FIGS. 10 and 11 may include an overstrike plate or region 62 made of a suitable material that protects the handle 14 from damage when a user misses an intended target with the striking surface 34 and strikes the handle. The overstrike plate 62 may be an added layer to the handle 14 or may be a thickened region of the overlay 60. In one embodiment, the overstrike plate 62 has a hardness less than that of the striking surface 34, the overlay 60, the handle 14, or the surface intended to be struck.

The handle 14 and/or head 18 may be formed by casting, fine blanking, plasma cutting, electrochemical machining, electrical discharge machining, metal injection molding, forging, rolling, extruding, milling, molding, die cutting, a computer numeric controlled machining operation, additive manufacturing, such as 3D printing, selective laser sintering, fused deposition modeling, or direct metal laser sintering or any other machining or manufacturing process suitable for a particular material incorporated into the striking tool.

The overlay 60 may be formed by extruding, molding, laminating, and any other process known in the art.

The grip 12 may be made of any suitable material or combinations of material, such as leather, plastic, rubber, wood, foam, an elastomeric material, and a vibration reducing grip material. In one embodiment, the grip material may have a Shore A durometer of from about 40 to about 80, or about 50 to about 75, or about 63 to about 73, or about 60, or about 65, or about 68. Grip materials contemplated for use also include those disclosed in U.S. Pat. No. 6,465,535.

Caps 32 contemplated herein may be formed of any suitable material or combinations of material and have any shape. For example, the cap 32 may be formed of steel or other metal, plastic, rubber, and combinations thereof, such as, for example, a rubber- or plastic-tipped cap with a metal or plastic base. In one embodiment, the cap 32 has a hardness greater than that of the head 18. In another embodiment, the cap 32 has a hardness equal to or less than the head 18.

One embodiment of striking tool 10 contemplated herein includes a handle 14 and head 18 made from a single piece of titanium, titanium alloy, or aluminum and one or more caps 32 made of steel affixed to the head by zero, one, or more bushings 44.

Another embodiment of striking tool 10 includes a handle 14 that extends at least part way through the separately formed head 18 and is secured thereto by means known in the art, such as a friction fit. In this embodiment, the handle 14 may be a plastic material or other light weight material and the head may be a light weight metal, such as aluminum, titanium, or an alloy thereof. One or more caps 32 made of steel may be affixed to the head 18 as described herein above.

In another embodiment, a striking tool 10 may have the handle 14 formed of a sheet metal to which the head 18 is attached, for example, by welding or other suitable manner. A striking cap 32 may be subsequently affixed to the head 18 as described herein above.

In a further embodiment, the striking tool 10 may be a pry bar (not shown) or a demolition tool that can be used for the demolition of construction materials or other materials with a cap attached to one end thereof to provide a striking surface 34 thereto. Examples of such tools are described in U.S. Pat. No. 6,629,684.

In a further embodiment, the striking tool 10 may incorporate additional features, such as a side nail puller or a lumber manipulating feature, such as described in U.S. Pat. No. 5,850,650.

Specific striking tools 10 contemplated herein include, for example, a nail hammer, an axe, a hatchet, a splitting tool, a welding chipping hammer, a drilling hammer, a sledge hammer, a tinner's hammer, an engineer's hammer, a cross peen hammer, a ball peen hammer, a lineman's hammer, a mason's hammer, a drywall hammer, a roofing hammer, a rock pick, an adze, a deadblow hammer, a tack hammer, a soft faced hammer, or any other tool used to strike a surface.

In one or more embodiments, the structural components illustrated herein are drawn to scale.

INDUSTRIAL APPLICABILITY

Striking tools with one or more striking surfaces attached thereto are described herein. Such striking tools combine the advantage of being able to be light weight while providing a striking surface of sufficient hardness and durability.

Numerous modifications will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the application are reserved. All patents and publications are incorporated by reference. All values and ratios disclosed herein may vary by ±10%, ±20%, or ±40%.

We claim:

1. A hammer, comprising:

a handle;

a head comprising a neck, the neck having a tapered receiving surface and an end face; and a cap comprising a tapered mounting surface, the mounting surface surrounding and engaging the receiving surface to permanently affix the cap to the neck, wherein a first circumference of engagement at a first end of a length of engagement between the mounting surface and the receiving surface is greater than a second circumference of engagement at a second end of the length of engagement, the first end being farther from the end face of the neck than the second end.

2. The hammer of claim 1, wherein the receiving surface is tapered relative to a longitudinal axis of the neck at an angle greater than zero degrees and less than or equal to seven degrees measured along a side of the receiving surface.

3. The hammer of claim 2, wherein the mounting surface is tapered relative to a longitudinal axis of the neck at an angle greater than zero degrees and less than or equal to seven degrees measured along a side of the mounting surface.

4. The hammer of claim 3, wherein the head and the handle are a single piece of aluminum.

5. The hammer of claim 4, wherein the cap is steel.

6. The hammer of claim 5, wherein a void space exists between the cap and the end face of the neck.

7. The hammer of claim 6, wherein the cap is affixed to the neck via only a friction fit.

8. The hammer of claim 6, wherein the mounting surface is in direct contact with the receiving surface.

9. The hammer of claim 6, wherein the cap is permanently affixed to the neck without a bushing.

10. The hammer of claim 6, further comprising a claw.

11. A hammer, comprising:

a cap including a striking surface, a cavity, and a tapered mounting surface within the cavity, the cap being a first material; and a head including a neck, the head being a second material different than the first material, the neck having a central axis and a tapered receiving surface, a portion of the neck received in the cavity to permanently affix the tapered receiving surface to the tapered mounting surface via a friction fit, the tapered receiving surface converging toward the central axis as the neck extends toward the striking surface.

12. The hammer of claim 11, further comprising a handle, the head and the handle being a single piece of the second material.

13. The hammer of claim 12, wherein the first material comprises steel.

14. The hammer of claim 13, wherein the second material comprises aluminum.

15. The hammer of claim 11, wherein a void space exists between the cap and the end face of the neck.

16. The hammer of claim 15, wherein the receiving surface is tapered relative to the central axis of the neck at an angle greater than zero degrees and less than or equal to ten degrees measured along a side of the receiving surface.

17. The hammer of claim 16, wherein the mounting surface is tapered relative to the central axis of the neck at an angle greater than zero degrees and less than or equal to ten degrees measured along a side of the mounting surface.

18. A striking tool, comprising:

a cap including a tapered mounting surface and a striking surface; and a head including a neck, the neck having a tapered receiving surface and an end face, a portion of the neck received in the cap to permanently affix the mounting surface to the receiving surface via a friction fit, a first circumference of engagement at a first end of a length of engagement between the mounting surface and the receiving surface being greater than a second circumference of engagement at a second end of the length of engagement, the first end being farther from the end face of the neck than the second end.

19. The striking tool of claim 18, wherein the cap is steel and the head is aluminum.

20. The striking tool of claim 18, wherein the receiving surface is tapered relative to a longitudinal axis of the neck at an angle between one degree and seven degrees measured along a side of the receiving surface, and wherein the mounting surface is tapered relative to the longitudinal axis of the neck at an angle between one degree and seven degrees measured along a side of the mounting surface.

* * * * *